US010886079B1

(12) United States Patent
Li et al.

(10) Patent No.: US 10,886,079 B1
(45) Date of Patent: Jan. 5, 2021

(54) KEYBOARD DEVICE

(71) Applicant: Chicony Electronics Co., Ltd., New Taipei (TW)

(72) Inventors: Po-Hsin Li, New Taipei (TW); Chi-Hung Cheng, New Taipei (TW)

(73) Assignee: CHICONY ELECTRONICS CO., LTD.

( * ) Notice: Subject to any disclaimer, the term of this patent is extended or adjusted under 35 U.S.C. 154(b) by 0 days.

(21) Appl. No.: 16/829,663

(22) Filed: Mar. 25, 2020

(30) Foreign Application Priority Data

Oct. 15, 2019 (TW) ..... 108137149 A

(51) Int. Cl.
*H01H 13/705* (2006.01)
*H01H 3/12* (2006.01)

(52) U.S. Cl.
CPC ..... *H01H 13/705* (2013.01); *H01H 3/125* (2013.01)

(58) Field of Classification Search
CPC ..... H01H 13/705; H01H 13/83; H01H 3/125; H01H 13/14; H01H 13/70; H01H 13/7065; H01H 2215/006; H01H 2233/07; H01H 13/52; H01H 13/20; H01H 2227/028; H01H 13/10; H01H 13/26
See application file for complete search history.

(56) References Cited

U.S. PATENT DOCUMENTS 6,118,092 A * 9/2000 Hayashi ..... H01H 3/125 200/344
2001/0002647 A1* 6/2001 Hayashi ..... H01H 3/125 200/344
2012/0118715 A1* 5/2012 Lin ..... H01H 3/125 200/344
2015/0107979 A1* 4/2015 Nishino ..... H01H 13/705 200/512
2017/0365422 A1* 12/2017 Watanabe ..... H01H 13/14

* cited by examiner

*Primary Examiner* — Ahmed M Saeed
(74) *Attorney, Agent, or Firm* — Muncy, Geissler, Olds & Lowe, P.C.

(57) ABSTRACT

A keyboard includes a substrate, a limit connecting member, a keycap, and a liftable connecting member. The assembly area of the substrate includes a through hole and a curved side wall standingly disposed on the substrate. The bottom edge of the curved side wall is adjacently connected to a periphery portion of the through hole. One side of the curved side wall facing the through hole includes a recessed groove. The limit connecting member is disposed on the assembly area and includes an inner fixing portion received in the through hole and an outer fixing portion enclosing the curved side wall and fixing with the inner fixing portion. The inner fixing portion has a protruding portion received in the recessed groove. The keycap is disposed on the assembly area. The liftable connecting member is connected between the keycap and the assembly area and is assembled with the limit connecting member.

13 Claims, 8 Drawing Sheets

KEYBOARD DEVICE

CROSS-REFERENCE TO RELATED APPLICATION

This non-provisional application claims priority under 35 U.S.C. § 119(a) to Patent Application No. 108137149 in Taiwan, R.O.C. on Oct. 15, 2019, the entire contents of which are hereby incorporated by reference.

BACKGROUND

Technical Field

The instant disclosure relates to an input device, in particular, to a keyboard device.

Related Art

Keyboards are common input devices. Usually, they are used along with daily computer products (such as laptops, notebook computers, smart phones, or tablets) or industrial scaled control equipment or processing equipment.

In general, a keyboard known to the inventor(s) has a substrate and several keycaps disposed on the substrate. Generally, a connecting member (such as a scissors-type connecting member) is disposed between each of the keycaps and the substrate. Hence, when the keycap is pressed, the keycap can be guided by the connecting member to perform an up-and-down movement relative to the substrate.

SUMMARY

However, the connecting member is assembled with a hook structure which is disposed on the substrate and integrally formed with the substrate by bending the substrate. In response to the "thin and light" trend in manufacturing the substrate, the structural strength of the hook structure is also reduced. As a result, upon being forced, the hook structure may be deformed easily or even broken.

In view of this, in one embodiment, a keyboard device is provided. The keyboard comprises a substrate, a limit connecting member, a keycap, and a liftable connecting member. The substrate has a top surface and a bottom surface opposite to the top surface. The top surface comprises an assembly area, and the assembly area comprises a through hole and a curved side wall. The through hole is defined through the top surface and the bottom surface of the substrate. The curved side wall is standingly disposed on the top surface. The curved side wall comprises a top edge and a bottom edge opposite to the top edge. The bottom edge is adjacently connected to a periphery portion of the through hole. One side of the curved side wall facing the through hole comprises a recessed groove, that is, a recessed groove is formed on one side of the curved side wall facing the through hole. The limit connecting member is disposed on the assembly area. The limit connecting member comprises an inner fixing portion and an outer fixing portion. The inner fixing portion is received in the through hole, the inner fixing portion further has a protruding portion, and the protruding portion is received in the recessed groove. The outer fixing portion encloses the curved side wall and fixes with the inner fixing portion. The keycap is disposed over the assembly area of the substrate. The liftable connecting member is connected between the keycap and the assembly area, and the liftable connecting member is assembled with the limit connecting member.

Based on the above, in the keyboard device according to one or some embodiments of the instant disclosure, the limit connecting member is a separated element and is assembled with the through hole and the curved side wall of the substrate, thereby greatly improving the structural strength of the limit connecting member. Moreover, as compared with the hook formed by bending the substrate of the keyboard device, the thickness of the substrate can be further reduced without affecting the structural strength of the limit connecting member. Consequently, the keyboard device can achieve the thin and light trend, and the limit connecting member can have a proper drawing force.

Moreover, according to one or some embodiments of the instant disclosure, the curved side wall is of a curved shape thereby greatly improving the yield strength (the toughness) for the curved side wall. Thus, the curved side wall does not break easily or exceed the elasticity limit upon being forced by the limit connecting member. Moreover, since the curved side wall is of a curved shape, the recessed groove may be provided to receive and position the limit connecting member, thereby improving the fixation strength between the limit connecting member and the substrate and preventing the limit connecting member from being deflected.

BRIEF DESCRIPTION OF THE DRAWINGS

The disclosure will become more fully understood from the detailed description given herein below for illustration only, and thus not limitative of the disclosure, wherein.

DETAILED DESCRIPTION

Embodiments are provided for facilitating the descriptions of the instant disclosure. However, the embodiments are provided as examples for illustrative purpose, but not a limitation to the instant disclosure. In all the figures, the same reference numbers refer to identical or similar elements.

Figure 1:
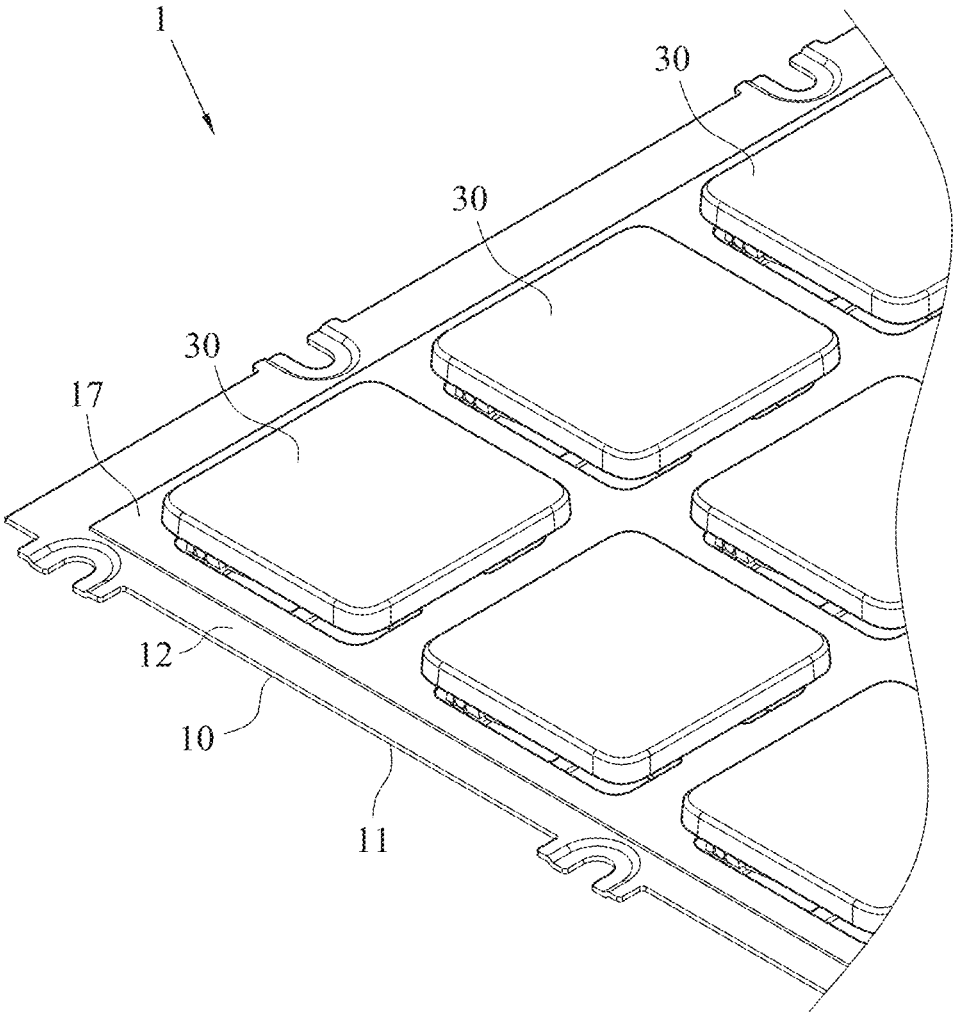
FIG. 1 illustrates a perspective view of a keyboard device according to an exemplary embodiment of the instant disclosure.
Figure 2:
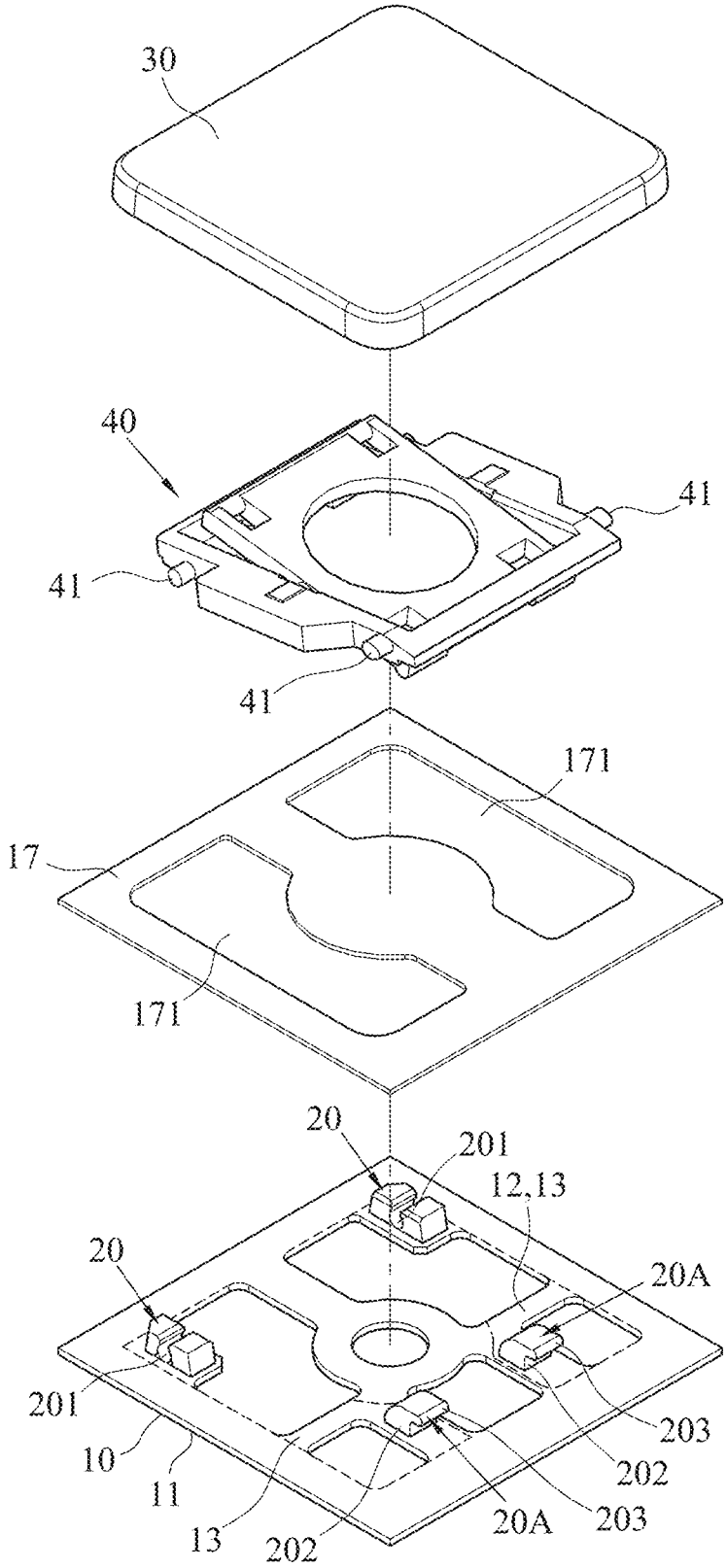
FIG. 2 illustrates a partial exploded view of the keyboard device of the exemplary embodiment.
Figure 3:
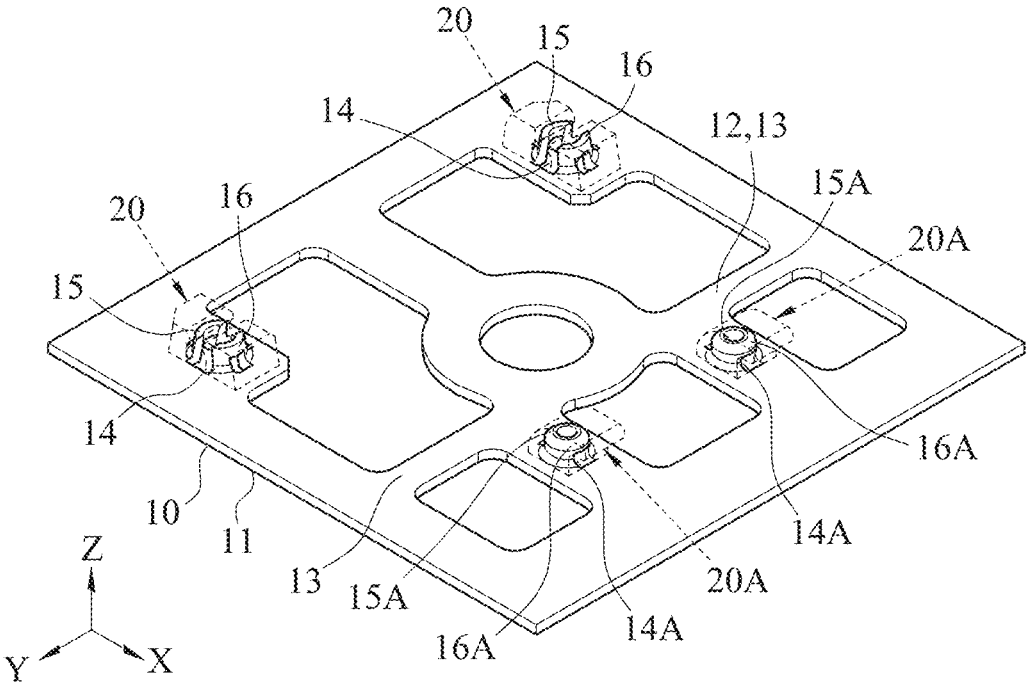
FIG. 3 illustrates a partial perspective view of the keyboard device of the exemplary embodiment.

FIG. 1 illustrates a perspective view of a keyboard device according to an exemplary embodiment of the instant disclosure. FIG. 2 illustrates a partial exploded view of the keyboard device of the exemplary embodiment. FIG. 3 illustrates a partial perspective view of the keyboard device of the exemplary embodiment. As shown in FIGS. 1 to 3, in this embodiment, the keyboard device 1 comprises a substrate 10 and a plurality of limit connecting members (as shown in FIG. 2, in this embodiment, the keyboard device 1 comprises two limit connecting members 20 and two limit connecting members 20A, but embodiments of the instant disclosure are not limited thereto), a plurality of keycaps 30, and a plurality of liftable connecting members 40. In some embodiments, the keyboard device 1 may be utilized in different electronic devices (e.g., laptop computers, notebook computers, or input devices of other electronic devices), and users can operate the keyboard device 1 to generate corresponding signal(s).

As shown in FIGS. 1 and 2, for example, the keyboard device 1 may be a computer keyboard, and a membrane circuit board 17 and several keys may be disposed on the substrate 10. The keys may comprise, for example, a plurality of alphabet keys, a plurality of number keys, a space key, an enter key, a caps lock key, etc. Each of the keys comprises a keycap 30, and the keys are disposed and arranged on the membrane circuit board 17. Each of the liftable connecting members 40 is connected between the substrate 10 and the corresponding keycap 30 for guiding the corresponding keycap 30 to perform an up-and-down movement (as shown in FIG. 2, in this embodiment, one keycap 30 and one liftable connecting member 40 are presented for illustrative purposes). When the keycap 30 is pressed, the keycap 30 is moved toward the membrane circuit board 17 downwardly to trigger a signal; conversely, when the keycap 30 is released, the keycap 30 is moved upwardly to a position where the keycap 30 is not pressed.

As shown in FIGS. 1 and 2, the substrate 10 may be a rigid plate made of metal (e.g., iron, aluminum, alloy, etc.), or plastic material. The substrate 10 has a bottom surface 11 and a top surface 12 opposite to the bottom surface 11, and the top surface 12 comprises a plurality of assembly areas 13. The assembly area 13 is an area for assembling the keycap 30 and the liftable connecting member 40 on the substrate 10. As shown in FIG. 2, in this embodiment, the membrane circuit board 17 comprises at least one blow hole 171 (in this embodiment, the membrane circuit board 17 comprises two blow holes 171). The assembly area 13 is an area of the top surface 12 of the substrate 10 corresponding to the blow hole 171 and not covered by the membrane circuit board 17 (as the area enclosed by dashed lines shown in FIG. 2).

Please refer to FIGS. 2 and 3. In this embodiment, the assembly area 13 of the substrate 10 comprises a through hole 14, a curved side wall 15, and an opposite side wall 16 for assembling with the limit connecting member 20, and the assembly area 13 of the substrate 10 further comprises a through hole 14A, a curved side wall 15A, and an opposite side wall 16A for assembling with the limit connecting member 20A. As shown in FIG. 3, the two limit connecting members 20 and the two limit connecting members 20A are illustrated by dashed lines to clearly show the positions and the shapes of the through holes 14, 14A, the curved side walls 15, 15A, and the opposite side walls 16, 16A. The two limit connecting members 20 and the two limit connecting members 20A are provided for assembling with the liftable connecting member 40. For example, in this embodiment, each of the liftable connecting members 40 is a scissors-type connecting member and has a plurality of shafts 41. The shafts 41 of the liftable connecting member 40 are respectively pivoted on the limit connecting members 20, 20A and the bottom portion of the keycap 30, so that the keycap 30 can be guided by the liftable connecting member 40 to perform an up-and-down movement relative to the substrate 10. However, it is understood that the liftable connecting member 40 is not limited to the scissors-type connecting member, and the liftable connecting member 40 may be connecting members in other configurations (e.g., the butterfly-type connecting member).

In some embodiments, the limit connecting members 20, 20A may have different configurations for assembling with the liftable connecting member 40. As shown in FIG. 2, in this embodiment, each of the limit connecting members 20 is of a U shape and has a pivot groove 201. In this embodiment, the cross section of the pivot groove 201 is of a water-drop shape, and the pivot groove 201 is recessed from a top portion of the limit connecting member 20, but embodiments are not limited thereto. Parts of the shafts 41 of the liftable connecting member 40 may be respectively pivoted on the pivot grooves 201 of the limit connecting members 20. Hence, when the liftable connecting member 40 is pressed, the shafts 41 are rotatable relative to the limit connecting members 20. Each of the limit connecting members 20A is of an L shape, and each of the limit connecting members 20A has a standing portion 202 and a hook portion 203. The standing portion 202 is protruding from the top surface 12 of the substrate 10, and the hook portion 203 is laterally extending from a top end of the standing portion 202. Parts of the shafts 41 of the liftable connecting member 40 may be disposed at the bottom portion of the hook portion 203. Hence, when the liftable connecting member 40 is pressed, the shafts 41 are rotatable relative to the limit connecting members 20A and are slidable along the extension direction of the hook portion 203.

In some embodiments, the limit connecting members 20 may be assembled with the through holes 14, the curved side walls 15, and the opposite side walls 16 by insert molding, injection molding, or hot melting, respectively. Similarly, the limit connecting members 20A may be assembled with the through holes 14A, the curved side walls 15A, and the opposite side walls 16A by insert molding, injection molding, or hot melting, respectively. According to one or some embodiments of the instant disclosure, the limit connecting member 20, 20A is integrally formed as a one-piece structure and the structural strength of the limit connecting member 20, 20A can be greatly improved. Moreover, as compared with the hook formed by bending the substrate of the keyboard device, the thickness of the substrate 10 can be further reduced without affecting the structural strength between the limit connecting members 20, 20A and the substrate 10. Consequently, the keyboard device 1 can achieve the "thin and light" trend, that is, the keyboard device 1 can be thinner and light-weighting, and the limit connecting member 20, 20A can have a proper drawing force. Detail structures of the limit connecting members 20, 20A are provided along with figures to show how the substrate 10 and the limit connecting members 20, 20A are assembled with each other.

Figure 5:
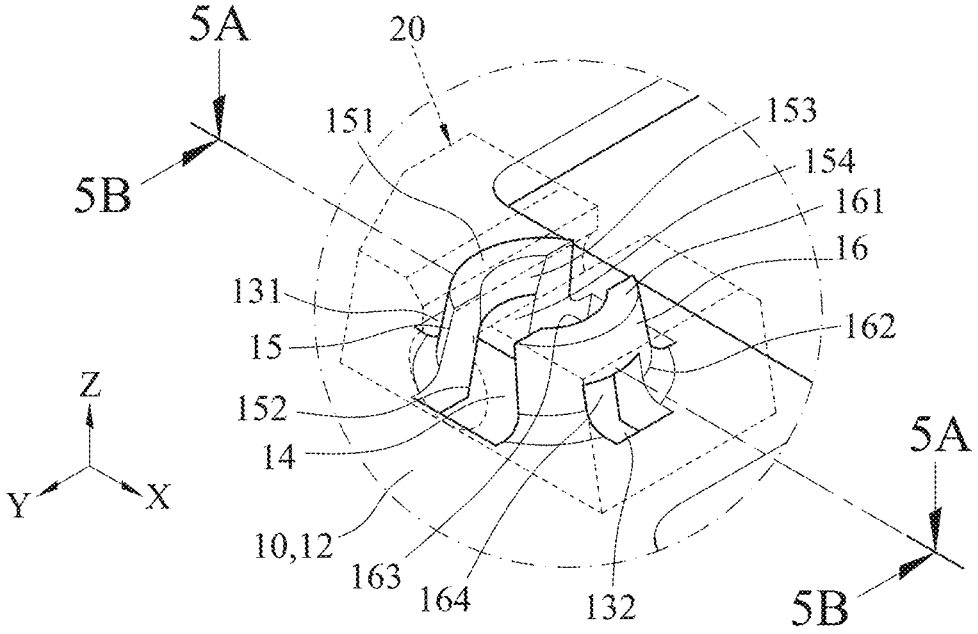
FIG. 5 illustrates an enlarged partial view of a limit connecting member shown in FIG. 3.
Figure 5A:
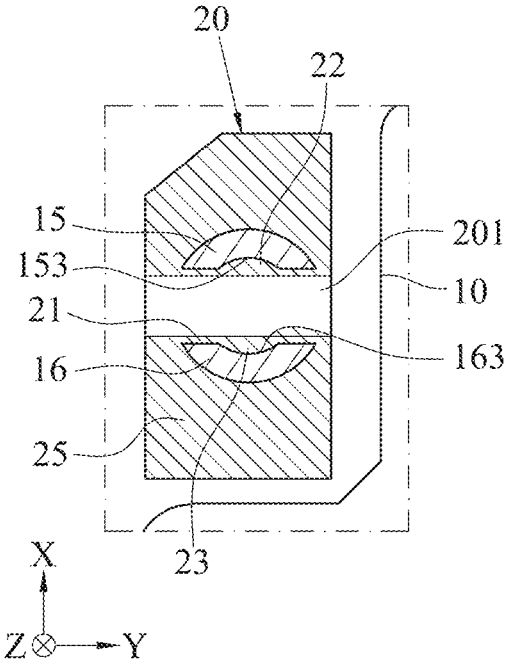
FIG. 5A illustrates a cross-sectional view of the limit connecting member shown in FIG. 5 along line 5A-5A.
Figure 5B:
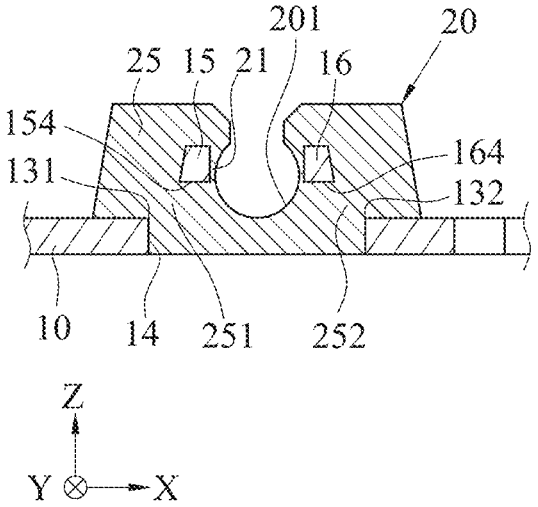
FIG. 5B illustrates a cross-sectional view of the limit connecting member shown in FIG. 5 along line 5B-5B.

Regarding the fixing structure between the limit connecting member 20 and the substrate 10, FIGS. 3, 5, 5A, and 5B are provided. FIG. 5 illustrates an enlarged partial view of the limit connecting member 20 shown in FIG. 3. FIG. 5A illustrates a cross-sectional view of the limit connecting member 20 shown in FIG. 5 along line 5A-5A. FIG. 5B illustrates a cross-sectional view of the limit connecting member 20 shown in FIG. 5 along line 5B-5B. In this embodiment, the through hole 14 of the assembly area 13 of the substrate 10 is defined through the bottom surface 11 and the top surface 12 of the substrate 10. For example, in this embodiment, the through hole 14 is defined through the bottom surface 11 and the top surface 12 of the substrate 10 along a Z-axis direction. The curved side wall 15 and the opposite side wall 16 are standingly disposed on the top surface 12. In this embodiment, the curved side wall 15 comprises a top edge 151 and a bottom edge 152 opposite to the top edge 151. The bottom edge 152 is adjacently connected to a periphery portion of the through hole 14. The opposite side wall 16 comprises a top portion 161 and a bottom portion 162, and the bottom portion 162 is adjacently connected to the periphery portion of the through hole 14. For example, the curved side wall 15 and the opposite side wall 16 may be formed by applying stamping or drawing processes to the substrate 10, so that portions of the substrate 10 are bent upwardly from one side of the substrate 10 opposite to the periphery portion of the through hole 14 to form the curved side wall 15 and the opposite side wall 16 protruding from the top surface 12 of the substrate 10 and of a standing configuration.

Please refer to FIGS. 3, 5, 5A, and 5B. In this embodiment, the curved side wall 15 and the opposite side wall 16 are curved walls. The opposite side wall 16 is spaced from the curved side wall 15, and the curved side wall 15 and the opposite side wall 16 are not connected with each other. In other words, the curved side wall 15 and the opposite side wall 16 are of a spaced configuration and an avoidance space is formed between the curved side wall 15 and the opposite side wall 16. After the limit connecting member 20 is assembled with the through hole 14, the curved side wall 15, and the opposite side wall 16, the pivot groove 201 of the limit connecting member 20 is located in the avoidance space between the curved side wall 15 and the opposite side wall 16. Hence, the pivot groove 201 is adapted for pivoting the shaft 41 of the liftable connecting member 40. One side of the curved side wall 15 facing the through hole 14 and the opposite side wall 16 comprises a recessed groove 153, that is, the recessed groove 153 is formed on one side of the curved side wall 15 facing the through hole 14 and the opposite side wall 16, and the recessed groove 153 is defined through the curved side wall 15 from the top edge 151 to the bottom edge 152. In this embodiment, the recessed groove 153 is defined through the curved side wall 15 from the top edge 151 to the bottom edge 152 along the Z-axis direction. Moreover, in this embodiment, the curved side wall 15 is an arc-shaped curved wall, and the recessed groove 153 is of an arc-shaped curved shape. Similarly, one side of the opposite side wall 16 facing the through hole 14 and the curved side wall 15 comprises an embedded groove 163, that is, the embedded groove 163 is formed on one side of the opposite side wall 16 facing the through hole 14 and the curved side wall 15, and the embedded groove 163 is defined through the opposite side wall 16 from the top portion 161 to the bottom portion 162. In this embodiment, the embedded groove 163 is defined through the opposite side wall 16 from the top portion 161 to the bottom portion 162 along the Z-axis direction. Moreover, in this embodiment, the opposite side wall 16 is an arc-shaped curved wall, and the embedded groove 163 is of an arc-shaped curved shape. However, it is understood that, the illustrated embodiments are provided for illustrative purposes, but not limitations. In some embodiments, the curved side wall 15 and the opposite side wall 16 may be of other shapes (e.g., U shape, V shape and the like), and the curvature of the curved side wall 15 and the curvature of the opposite side wall 16 may be the same or different.

As shown in FIGS. 3, 5, 5A, and 5B, each of the limit connecting members 20 comprises an inner fixing portion 21 and an outer fixing portion 25. The inner fixing portion 21 is received in the through hole 14 and is disposed between the curved side wall 15 and the opposite side wall 16. Two protruding portions 22, 23 are integrally formed on the opposite sides of the inner fixing portion 21. The protruding portion 22 is received in the recessed groove 153 of the curved side wall 15, and the protruding portion 23 is received in the embedded groove 163 of the opposite side wall 16. The outer fixing portion 25 of each of the limit connecting members 20 encloses the curved side wall 15 and the opposite side wall 16 and fixes with the inner fixing portion 21. As mentioned above, each of the limit connecting members 20 may be of a one-piece structure, so that the inner fixing portion 21 and the outer fixing portion 25 of each of the limit connecting members 20 are integrally connected with each other.

Consequently, according to one or some embodiments of the instant disclosure, the curved side wall 15 and the opposite side wall 16 are of curved shapes, thereby greatly improving the yield strength (the toughness) for the curved side wall 15 and the opposite side wall 16. Hence, when the curved side wall 15 and the opposite side wall 16 are forced by the limit connecting member 20, for example, when the limit connecting member 20 provides a pressing force (e.g. a force applied in the X-axis direction shown in FIG. 5) on the curved side wall 15 and the opposite side wall 16 due to the movement of the liftable connecting member 40, the curved side wall 15 and the opposite side wall 16 do not break easily or deformations of the curved side wall 15 and the opposite side wall 16 do not exceed the elasticity limit. Moreover, since the curved side wall 15 and the opposite side wall 16 are of curved shapes, the recessed groove 153 and the embedded groove 163 may be provided to receive and position the two protruding portions 22, 23 of the limit connecting member 20, respectively, thereby improving the fixation strength between the limit connecting member 20 and the substrate 10 and preventing the limit connecting member 20 from being deflected. For example, as shown in FIG. 5A, if the limit connecting member 20 is forced by a force in the Y-axis direction, since the two protruding portions 22, 23 of the limit connecting member 20 are respectively received in the recessed groove 153 of the curved side wall 15 and the embedded groove 163 of the opposite side wall 16, the limit connecting member 20 can be further limited by the curved side wall 15 and the opposite side wall 16 in the Y-axis direction to prevent from being deflected.

Furthermore, as shown in FIGS. 3, 5, 5A, and 5B, in this embodiment, the assembly area 13 of the substrate 10 further comprises two engaging holes 131, 132 respectively adjacent to the curved side wall 15 and the opposite side wall 16. The outer fixing portion 25 of the limit connecting member 20 further comprises two engaging portions 251, 252. The two engaging portions 251, 252 are respectively received in the engaging holes 131, 132, and the two engaging portions 251, 252 are integrally fixed with the inner fixing portion 21. Hence, the outer fixing portion 25, the engaging portion 251, and the inner fixing portion 21 of the limit connecting member 20 enclose the curved side wall 15. Moreover, the outer fixing portion 25, the engaging portion 252, and the inner fixing portion 21 of the limit connecting member 20 enclose the opposite side wall 16. Accordingly, the engaging force between the limit connecting member 20 and the curved side wall 15 and the engaging force between the limit connecting member 20 and the opposite side wall 16 can be greatly improved, thereby increasing the drawing force of the limit connecting member 20.

Furthermore, as shown in FIGS. 3, 5, 5A, and 5B, in this embodiment, the engaging holes 131, 132 are further in communication with the through hole 14. Moreover, the bottom edge 152 of the curved side wall 15 has a notch 154, the bottom portion 162 of the opposite side wall 16 has a notch 164, and the two notches 154, 164 are respectively in communication with the engaging holes 131, 132. The two engaging portions 251, 252 of the outer fixing portion 25 of the limit connecting member 20 are further received in the two notches 154, 164, respectively. Thus, the portions of the curved side wall 15 enclosed by the limit connecting member 20 and the portions of the opposite side wall 16 enclosed by the limit connecting member 20 can be further increased, thereby further improving the engaging force and the drawing force of the limit connecting member 20.

Figure 6:
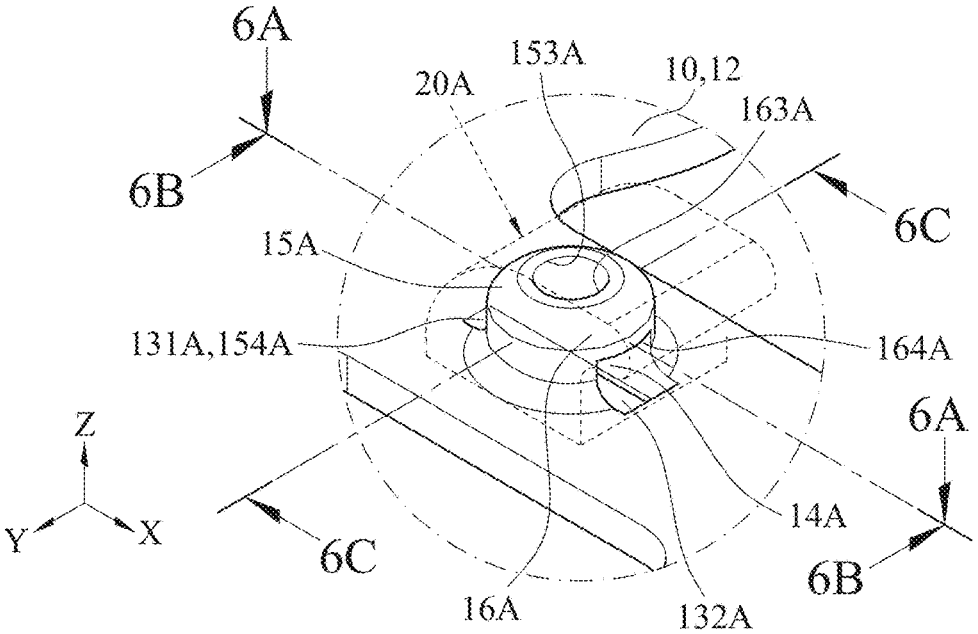
FIG. 6 illustrates an enlarged partial view of another limit connecting member shown in FIG. 3.
Figure 6A:
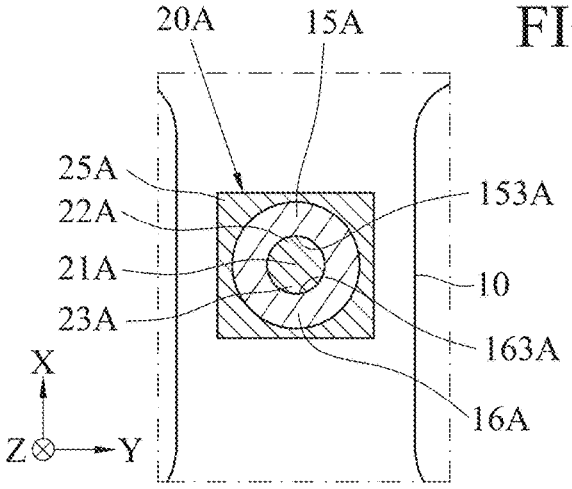
FIG. 6A illustrates a cross-sectional view of the limit connecting member shown in FIG. 6 along line 6A-6A.
Figure 6B:
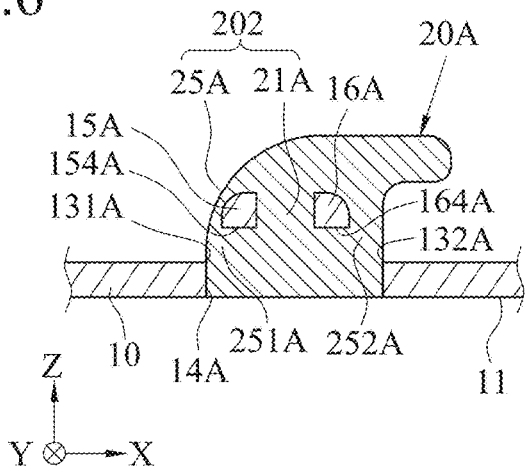
FIG. 6B illustrates a cross-sectional view of the limit connecting member shown in FIG. 6 along line 6B-6B.
Figure 6C:
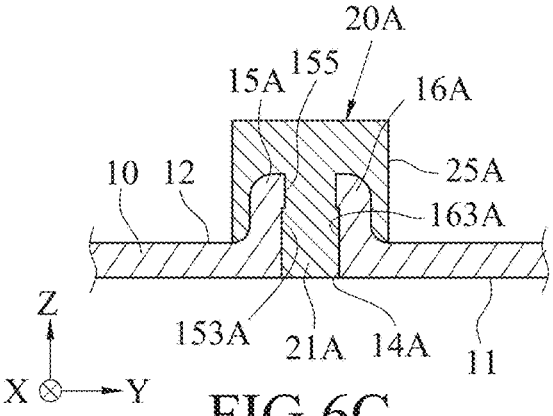
FIG. 6C illustrates a cross-sectional view of the limit connecting member shown in FIG. 6 along line 6C-6C.

Regarding the fixing structure between the limit connecting member 20A and the substrate 10, FIGS. 3, 6, 6A, 6B, and 6C are provided. FIG. 6 illustrates an enlarged partial view of the limit connecting member 20A shown in FIG. 3. FIG. 6A illustrates a cross-sectional view of the limit connecting member 20A shown in FIG. 6 along line 6A-6A. FIG. 6B illustrates a cross-sectional view of the limit connecting member 20A shown in FIG. 6 along line 6B-6B. FIG. 6C illustrates a cross-sectional view of the limit connecting member 20A shown in FIG. 6 along line 6C-6C. The limit connecting member 20A in this embodiment and the limit connecting member 20 of the embodiment shown in FIG. 5 at least have following identical or similar features. In this embodiment, the through hole 14A of the assembly area 13 of the substrate 10 is defined through the bottom surface 11 and the top surface 12 of the substrate 10. The curved side wall 15A and the opposite side wall 16A are standingly disposed on the top surface 12 and are connected to the periphery portion of the through hole 14A. For example, the curved side wall 15A and the opposite side wall 16A may be formed by applying stamping or drawing processes to the substrate 10, so that portions of the substrate 10 are bent upwardly from one side of the substrate 10 opposite to the periphery portion of the through hole 14A to form the curved side wall 15A and the opposite side wall 16A protruding from the top surface 12 of the substrate 10 and of a standing configuration.

Further, as shown in FIGS. 3, 6, 6A, 6B, and 6C, the limit connecting member 20A in this embodiment and the limit connecting member 20 of the embodiment shown in FIG. 5 at least have following different features. In this embodiment, the curved side wall 15A and the opposite side wall 16A cooperatively enclose to form an annular wall. One side of the curved side wall 15A facing the through hole 14A and the opposite side wall 16A comprises a recessed groove 153A, that is, the recessed groove 153A is formed on one side of the curved side wall 15A facing the through hole 14A and the opposite side wall 16A. One side of the opposite side wall 16A facing the through hole 14A and the curved side wall 15A comprises an embedded groove 163A, that is, the embedded groove 163A is formed on one side of the opposite side wall 16A facing the through hole 14A and the curved side wall 15A. The recessed groove 153A and the embedded groove 163A co-form a vertical through hole (in this embodiment, the recessed groove 153A and the embedded groove 163A are defined through the curved side wall 15A and the opposite side wall 16A, respectively, along the Z-axis direction).

Moreover, as shown in FIGS. 3, 6, 6A, 6B, and 6C, the standing portion 202 of each of the limit connecting members 20A comprises an inner fixing portion 21A and an outer fixing portion 25A (referring to FIGS. 2 and 6B, the standing portion 202 encloses the curved side wall 15A). The inner fixing portion 21A is received in the through hole 14A, and two protruding portions 22A, 23A are disposed on opposite sides of the inner fixing portion 21A. The protruding portion 22A is received in the recessed groove 153A of the curved side wall 15A, and the protruding portion 23A is received in the embedded groove 163A of the opposite side wall 16A. The outer fixing portion 25A of each of the limit connecting members 20A encloses the curved side wall 15A and the opposite side wall 16A and fixes with the inner fixing portion 21A integrally. Consequently, according to one or some embodiments of the instant disclosure, the curved side walls 15A and the opposite side wall 16A are of curved shapes, thereby greatly improving the yield strength (the toughness) for the curved side wall 15A and the opposite side wall 16A. Hence, the curved side wall 15A and the opposite side wall 16A do not break easily or deformations of the curved side wall 15A and the opposite side wall 16A do not exceed the elasticity limit. Moreover, since the two protruding portions 22A, 23A of the limit connecting member 20A are respectively received in the recessed groove 153A of the curved side wall 15A and the embedded groove 163A of the opposite side wall 16A, the limit connecting member 20A can be further limited and positioned by the curved side wall 15A and the opposite side wall 16A, thereby improving the fixation strength between the limit connecting member 20A and the substrate 10 and preventing the limit connecting member 20A from being deflected.

Further, as shown in FIGS. 3, 6, 6A, 6B, and 6C, in this embodiment, the assembly area 13 of the substrate 10 further comprises two engaging holes 131A, 132A respectively adjacent to the curved side wall 15A and the opposite side wall 16A. The outer fixing portion 25A of the limit connecting member 20A further comprises two engaging portions 251A, 252A. The two engaging portions 251A, 252A are respectively received in the engaging holes 131A, 132A, and the two engaging portions 251A, 252A are integrally fixed with the inner fixing portion 21A. Hence, the outer fixing portion 25A, the engaging portion 251A, and the inner fixing portion 21A of the limit connecting member 20A enclose the curved side wall 15A. Moreover, the outer fixing portion 25A, the engaging portion 252A, and the inner fixing portion 21A enclose the opposite side wall 16A. Accordingly, the engaging force between the limit connecting member 20A and the curved side wall 15A and the engaging force between the limit connecting member 20A and the opposite side wall 16A can be greatly improved, thereby increasing the drawing force of the limit connecting member 20A.

Furthermore, as shown in FIGS. 3, 6, 6A, 6B, and 6C, in this embodiment, the engaging holes 131A, 132A are further in communication with the through hole 14A. Moreover, the curved side wall 15A has a notch 154A, the opposite side wall 16A has a notch 164A, and the two notches 154A, 164A are respectively in communication with the engaging holes 131A, 132A. The two engaging portions 251A, 252A of the outer fixing portion 25A of the limit connecting member 20A are further received in the two notches 154A, 164A, respectively, so that the portions of the curved side wall 15A enclosed by the limit connecting member 20A and the portions of the opposite side wall 16A enclosed by the limit connecting member 20A can be further increased, thereby further improving the engaging force and the drawing force of the limit connecting member 20A.

As shown in FIG. 6C, in this embodiment, one side of the curved side wall 15A of the limit connecting member 20A facing the through hole 14A further comprises a flange 155 to form a stepped surface, so that portions of the inner fixing portion 21A of the limit connecting member 20A can be fixed below the flange 155 and limited by the flange 155, thereby further improving the drawing force of the limit connecting member 20A. Moreover, in this embodiment, the flange 155 may be an annular flange and extending toward one side of the opposite side wall 16A facing the through hole 14A. Therefore, the area of the inner fixing portion 21A fixed below the flange 155 can be increased; however, embodiments are not limited thereto.

Figure 6D:
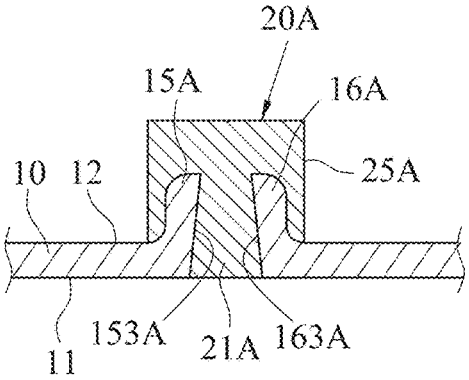
FIG. 6D illustrates a cross-sectional view of the limit connecting member shown in FIG. 6C according to another embodiment.

Please refer to FIG. 6D. FIG. 6D illustrates another cross-sectional view of the limit connecting member 20A shown in FIG. 6C according to another embodiment. The limit connecting member 20A in this embodiment and the limit connecting member 20A of the embodiment shown in FIG. 6C at least have following different features. In this embodiment, the recessed groove 153A of the curved side wall 15A and the embedded groove 163A of the opposite side wall 16A of the limit connecting member 20A have the taper slope. For instance, the vertical through hole formed by the recessed groove 153A and the embedded groove 163A may be a tapered through hole and has a taper slope, so that the inner fixing portion 21A of the limit connecting member 20A can be further limited and positioned by the recessed groove 153A and the embedded groove 163A due to the taper slope, thereby further improving the drawing force of the limit connecting member 20A.

In some embodiments, the keyboard device 1 may have one type of limit connecting member. For instance, the assembly area 13 of the substrate 10 may be only assembled with the limit connecting members 20 or may be only assembled with the limit connecting members 20A. The embodiments shown in FIGS. 2 and 3 where two types of limit connecting members (the limit connecting member 20 and the limit connecting member 20A) are provided are taken as illustrative purposes, but not limitations.

Figure 4:
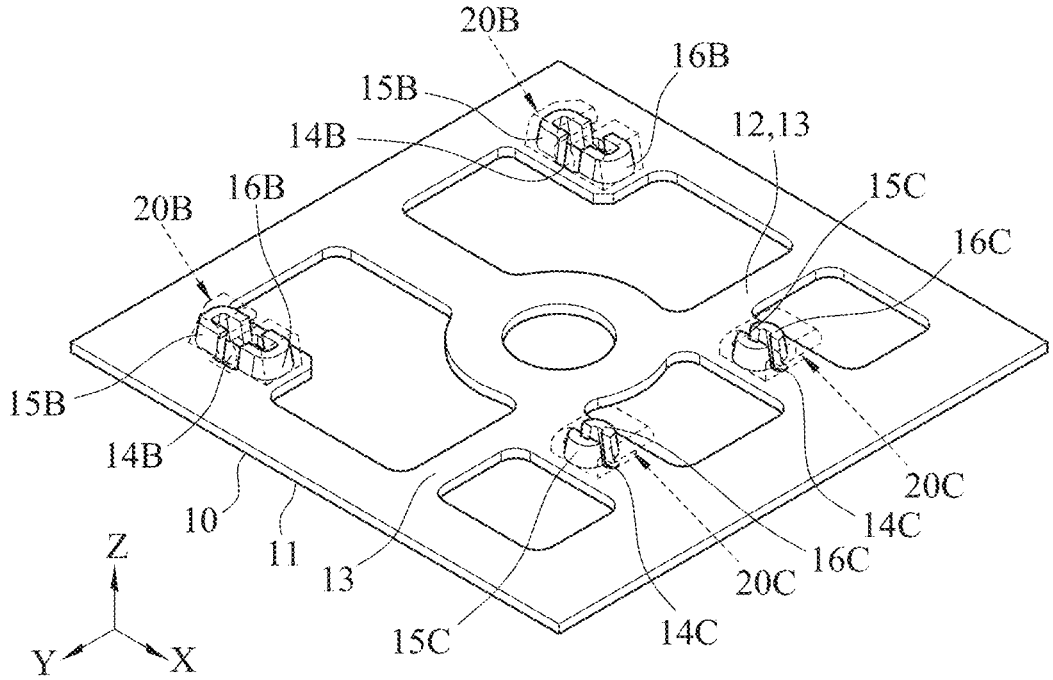
FIG. 4 illustrates a partial perspective view of a keyboard device according to another exemplary embodiment of the instant disclosure.

Please refer to FIG. 4. FIG. 4 illustrates a partial perspective view of a keyboard device according to another exemplary embodiment of the instant disclosure. The keyboard device 1 in this embodiment and the keyboard device 1 shown in FIG. 3 at least have following different features. In this embodiment, two limit connecting members 20B and two limit connecting members 20C are disposed on the assembly area 13 of the substrate 10. The assembly area 13 of the substrate 10 comprises a through hole 14B, a curved side wall 15B, and an opposite side wall 16B for assembling with the limit connecting member 20B, and the assembly area 13 of the substrate 10 further comprises a through hole 14C, a curved side wall 15C, and an opposite side wall 16C for assembling with the limit connecting member 20C. As shown in FIG. 4, the two limit connecting members 20B and the two limit connecting members 20C are illustrated by dashed lines to clearly show the positions and the shapes of the through holes 14B, 14C, the curved side walls 15B, 15C, and the opposite side walls 16B, 16C. The limit connecting members 20B, 20C may have different configurations for assembling with the liftable connecting member 40 (as shown in FIG. 2). As shown in FIG. 4, in this embodiment, each of the limit connecting members 20B is of a U shape, and each of the limit connecting members 20C is of an L shape, but embodiments of the instant disclosure are not limited thereto. The structures of the limit connecting members 20B, 20C are similar to the structures of the limit connecting members 20, 20A, respectively, repeated descriptions are thus omitted.

In some embodiments, the limit connecting member 20B may be assembled with the through hole 14B, the curved side wall 15B, and the opposite side wall 16B by insert molding, injection molding, or hot melting, respectively. Similarly, the limit connecting member 20C may be assembled with the through hole 14C, the curved side wall 15C, and the opposite side wall 16C by insert molding, injection molding, or hot melting, respectively. As compared with the keyboard device, where the structural strength of the hook formed by bending the substrate is reduced after the thickness of the substrate is reduced, according to one or some embodiments of the instant disclosure, the limit connecting member 20B, 20C is integrally formed as a one-piece structure and the structural strength of the limit connecting member 20B, 20C can be greatly improved. Moreover, as compared with the hook formed by bending the substrate of the keyboard device, in this embodiment, the thickness of the substrate 10 can be further reduced without affecting the structural strength of the limit connecting member 20B, 20C pivoted on the liftable connecting member 40. Consequently, the keyboard device 1 can achieve the thin and light trend, and the limit connecting member 20B, 20C can have a proper or an even better drawing force. Detail structures of the limit connecting members 20B, 20C are provided along with figures to show how the substrate 10 and the limit connecting members 20B, 20C are assembled with each other.

Figure 7:
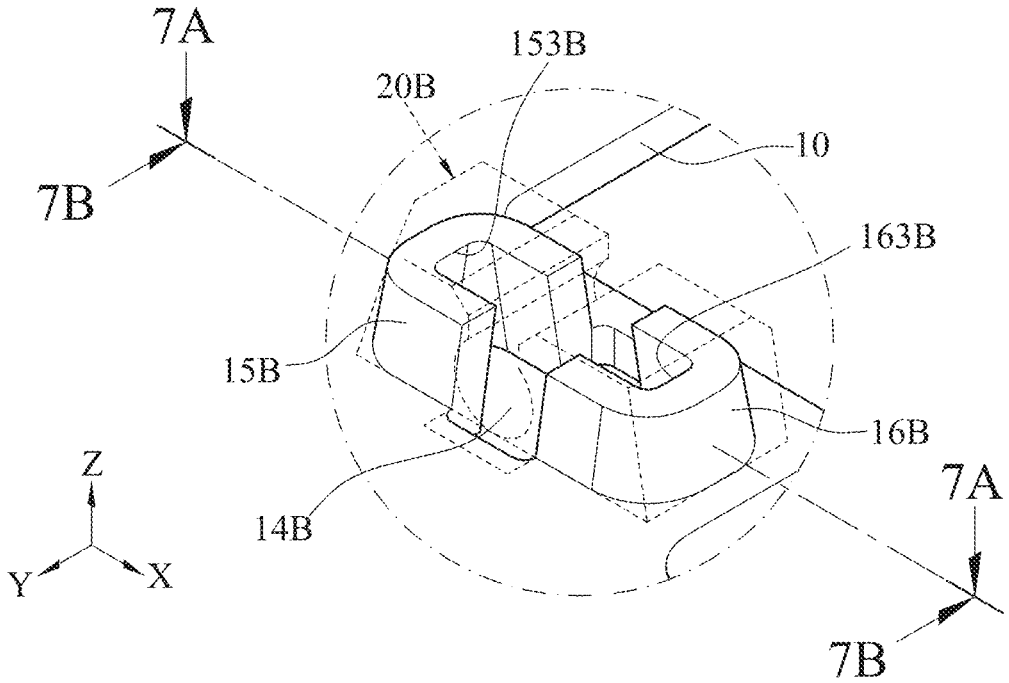
FIG. 7 illustrates an enlarged partial view of the limit connecting member shown in FIG. 4.
Figure 7A:
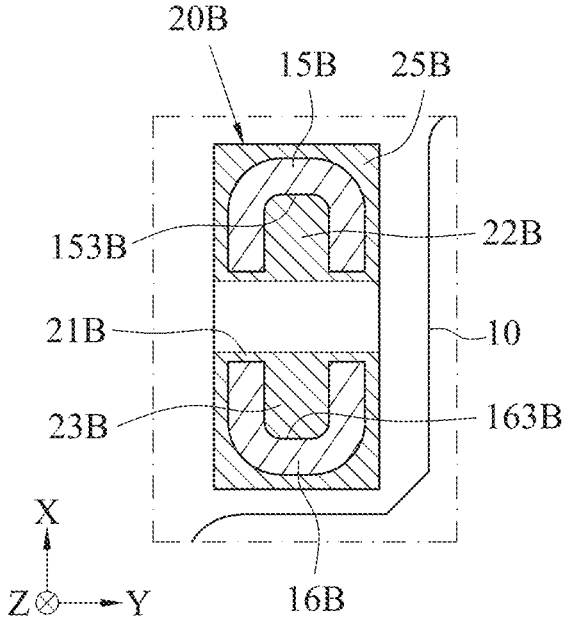
FIG. 7A illustrates a cross-sectional view of the limit connecting member shown in FIG. 7 along line 7A-7A.
Figure 7B:
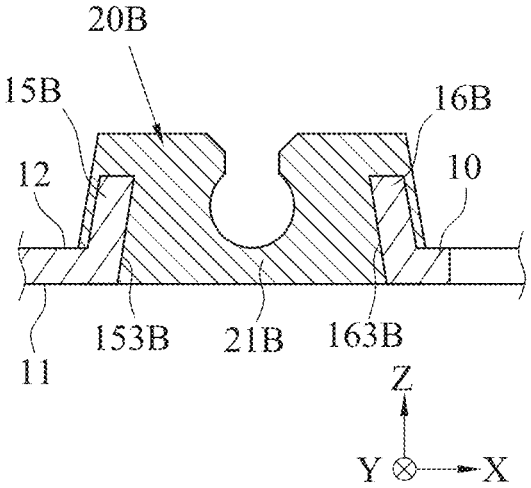
FIG. 7B illustrates a cross-sectional view of the limit connecting member shown in FIG. 7 along line 7B-7B.

Regarding the fixing structure between the limit connecting member 20B and the substrate 10, FIGS. 4, 7, 7A, and 7B are provided. FIG. 7 illustrates an enlarged partial view of the limit connecting member 20B shown in FIG. 4. FIG. 7A illustrates a cross-sectional view of the limit connecting member 20B shown in FIG. 7 along line 7A-7A. FIG. 7B illustrates a cross-sectional view of the limit connecting member 20B shown in FIG. 7 along line 7B-7B. The limit connecting member 20B in this embodiment and the limit connecting member 20 of the embodiment shown in FIG. 5 at least have following identical or similar features. In this embodiment, the through hole 14B of the assembly area 13 of the substrate 10 is defined through the bottom surface 11 and the top surface 12 of the substrate 10. For example, in this embodiment, the through hole 14B is defined through the bottom surface 11 and the top surface 12 of the substrate 10 along the Z-axis direction. The curved side wall 15B and the opposite side wall 16B are standingly disposed on the top surface 12. For example, the curved side wall 15B and the opposite side wall 16B may be formed by applying stamping or drawing processes to the substrate 10, so that portions of the substrate 10 are bent upwardly from one side of the substrate 10 opposite to the periphery portion of the through hole 14B to form the curved side wall 15B and the opposite side wall 16B protruding from the top surface 12 of the substrate 10 and of a standing configuration.

Further, as shown in FIGS. 4, 7, 7A, and 7B, the curved side wall 15B and the opposite side wall 16B in this embodiment and the curved side wall 15 and the opposite side wall 16 of the embodiment shown in FIG. 5 at least have following different features. In this embodiment, the curved side wall 15B and the opposite side wall 16B are U-shaped curved walls and are spaced from each other. Hence, one side of the curved side wall 15B facing the through hole 14B and the opposite side wall 16B comprises a recessed groove 153B, and the recessed groove 153B is of a U shape. Similarly, one side of the opposite side wall 16B facing the through hole 14B and the curved side wall 15B comprises an embedded groove 163B, and the embedded groove 163B is of a U shape. However, it is understood that the illustrated embodiments are provided for illustrative purposes, but not limitations. In some embodiments, the curved side wall 15B and the opposite side wall 16B may be of other curved shapes, and the curvature of the curved side wall 15B and the curvature of the opposite side wall 16B may be the same or different.

As shown in FIGS. 4, 7, 7A, and 7B, each of the limit connecting members 20B comprises an inner fixing portion 21B and an outer fixing portion 25B. The inner fixing portion 21B is received in the through hole 14B, and two protruding portions 22B, 23B are on opposite sides of the inner fixing portion 21B. The protruding portion 22B is received in the recessed groove 153B of the curved side wall 15B, and the protruding portion 23B is received in the embedded groove 163B of the opposite side wall 16B. The outer fixing portion 25B of each of the limit connecting members 20B encloses the curved side wall 15B and the opposite side wall 16B and fixes with the inner fixing portion 21B. Consequently, according to one or some embodiments of the instant disclosure, the curved side wall 15B and the opposite side wall 16B are of U shapes, thereby greatly improving the yield strength (the toughness) for the curved side wall 15B and the opposite side wall 16B. Thus, the curved side wall 15B and the opposite side wall 16B do not break easily or deformations of the curved side wall 15B and the opposite side wall 16B do not exceed the elasticity limit. Moreover, since the two protruding portions 22B, 23B of the limit connecting member 20B are respectively received in the recessed groove 153B of the curved side wall 15B and the embedded groove 163B of the opposite side wall 16B, the limit connecting member 20B can be further limited by the curved side wall 15B and the opposite side wall 16B, thereby improving the fixation strength between the limit connecting member 20B and the substrate 10 and preventing the limit connecting member 20B from being deflected.

As shown in FIG. 7B, in this embodiment, the recessed groove 153B of the curved side wall 15B and the embedded groove 163B of the opposite side wall 16B of limit connecting member 20B have the taper slope. Therefore, the inner fixing portion 21B of the limit connecting member 20B can be limited by the recessed groove 153B and the embedded groove 163B due to the taper slope, thereby further improving the drawing force of the limit connecting member 20B.

Figure 8:
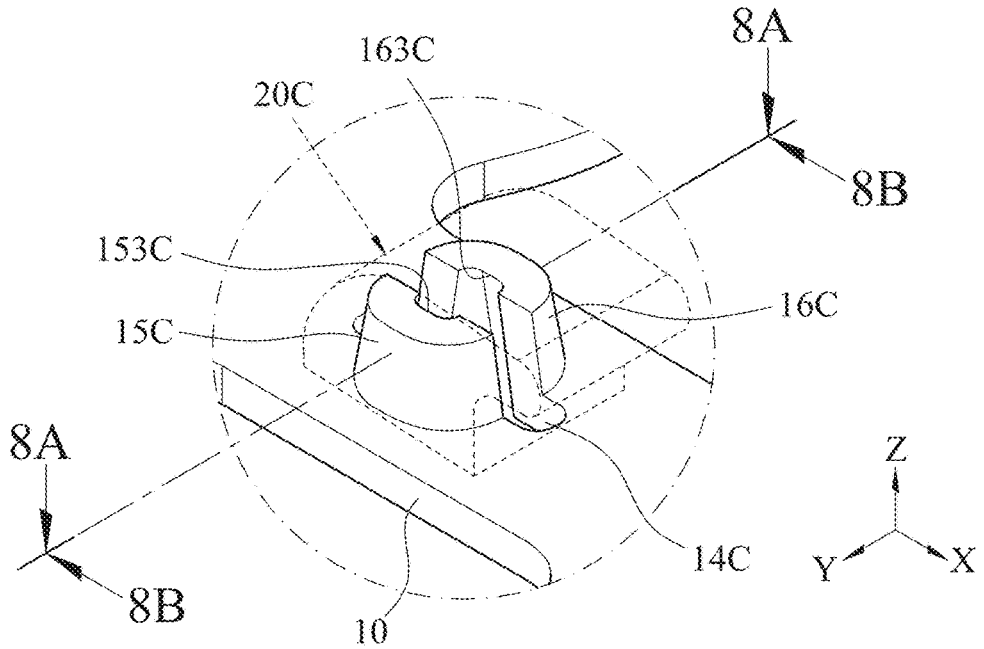
FIG. 8 illustrates an enlarged partial view of another limit connecting member shown in FIG. 4.
Figure 8A:
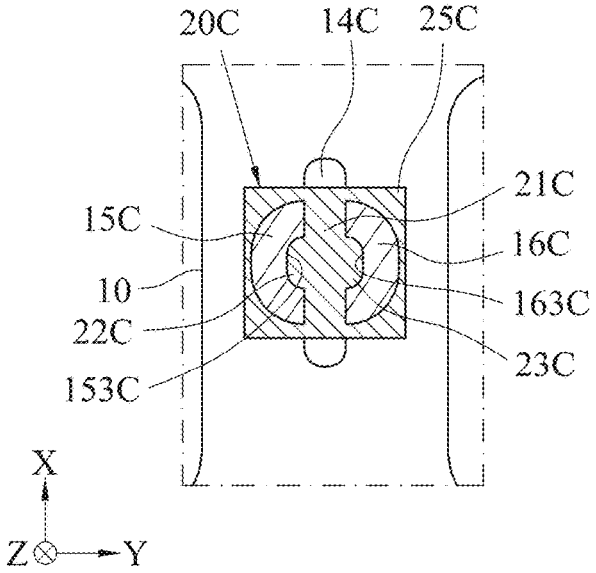
FIG. 8A illustrates a cross-sectional view of the limit connecting member shown in FIG. 8 along line 8A-8A.
Figure 8B:
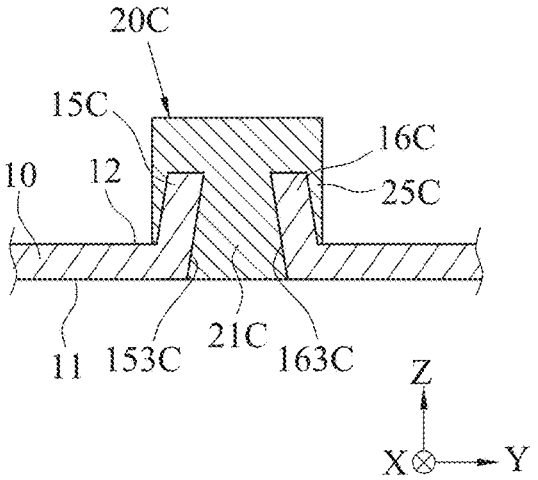
FIG. 8B illustrates a cross-sectional view of the limit connecting member shown in FIG. 8 along line 8B-8B.

Regarding the fixing structure between the limit connecting member 20C and the substrate 10, FIGS. 4, 8, 8A, and 8B are provided. FIG. 8 illustrates an enlarged partial view of the limit connecting member 20C shown in FIG. 4. FIG. 8A illustrates a cross-sectional view of the limit connecting member 20C shown in FIG. 8 along line 8A-8A. FIG. 8B illustrates a cross-sectional view of the limit connecting member 20C shown in FIG. 8 along line 8B-8B. The limit connecting member 20C in this embodiment and the limit connecting member 20B of the embodiment shown in FIG. 7 at least have following identical or similar features. In this embodiment, the through hole 14C of the assembly area 13 of the substrate 10 is defined through the bottom surface 11 and the top surface 12 of the substrate 10. For example, in this embodiment, the through hole 14C is defined through the bottom surface 11 and the top surface 12 of the substrate 10 along the Z-axis direction. The curved side wall 15C and the opposite side wall 16C are standingly disposed on the top surface 12. For example, the curved side wall 15C and the opposite side wall 16C may be formed by applying stamping or drawing processes to the substrate 10, so that portions of the substrate 10 are bent upwardly from one side of the substrate 10 opposite to the periphery portion of the through hole 14C to form the curved side wall 15C and the opposite side wall 16C protruding from the top surface 12 of the substrate 10 and of a standing configuration.

Further, as shown in FIGS. 4, 8, 8A, and 8B, the curved side wall 15C and the opposite side wall 16C in this embodiment and the curved side wall 15B and the opposite side wall 16B of the embodiment shown in FIG. 7 at least have following different features. In this embodiment, the curved side wall 15C and the opposite side wall 16C are curved walls and are spaced from each other. One side of the curved side wall 15C facing the through hole 14C and the opposite side wall 16C comprises a recessed groove 153C, and the recessed groove 153C is of a curved shape. Similarly, one side of the opposite side wall 16C facing the through hole 14C and the curved side wall 15C comprises an embedded groove 163C, and the embedded groove 163C is of a curved shape. However, it is understood that the illustrated embodiments are provided for illustrative purposes, but not limitations. In some embodiments, the curved side wall 15C and the opposite side wall 16C may be of other curved shapes, and the curvature of the curved side wall 15C and the curvature of the opposite side wall 16C may be the same or different.

As shown in FIGS. 4, 8, 8A, and 8B, each of the limit connecting members 20C comprises an inner fixing portion 21C and an outer fixing portion 25C. The inner fixing portion 21C is received in the through hole 14C, and two protruding portions 22C, 23C are on opposite sides of the inner fixing portion 21C. The protruding portion 22C is received in the recessed groove 153C of the curved side wall 15C, and the protruding portion 23C is received in the embedded groove 163C of the opposite side wall 16C. The outer fixing portion 25C of each of the limit connecting members 20C encloses the curved side wall 15C and the opposite side wall 16C and fixes with the inner fixing portion 21C. Consequently, according to one or some embodiments of the instant disclosure, the curved side wall 15C and the opposite side wall 16C are of curved shapes, thereby greatly improving the yield strength (the toughness) for the curved side wall 15C and the opposite side wall 16C. Thus, the curved side wall 15C and the opposite side wall 16C do not break easily or deformations of the curved side wall 15C and the opposite side wall 16C do not exceed the elasticity limit. Moreover, since the two protruding portions 22C, 23C of the limit connecting member 20C are respectively received in the recessed groove 153C of the curved side wall 15C and the embedded groove 163C of the opposite side wall 16C, the limit connecting member 20C can be further limited by the curved side wall 15C and the opposite side wall 16C, thereby improving the fixation strength between the limit connecting member 20C and the substrate 10 and preventing the limit connecting member 20C from being deflected.

As shown in FIG. 8B, in this embodiment, the recessed groove 153C of the curved side wall 15C and the embedded groove 163C of the opposite side wall 16C of the limit connecting member 20C have the taper slope. Therefore, the inner fixing portion 21C of the limit connecting member 20C can be limited by the recessed groove 153C and the embedded groove 163C due to the taper slope, thereby further improving the drawing force of the limit connecting member 20C.

In some embodiments, the keyboard device 1 may just have the limit connecting member 20B or the limit connecting member 20C. The embodiments shown in FIG. 4 where two types of limit connecting members (the limit connecting member 20B and the limit connecting member 20C) are provided are taken as illustrative purposes, but not limitations.

Figure 9:
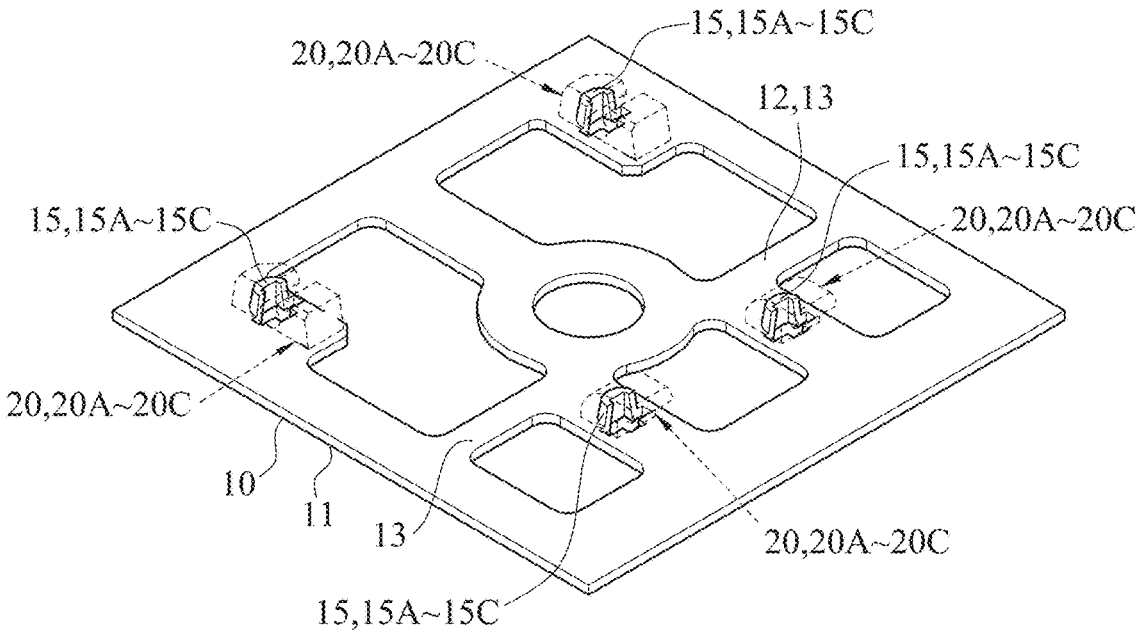
FIG. 9 illustrates a partial perspective view of a keyboard device according to another exemplary embodiment of the instant disclosure.
Figure 10:
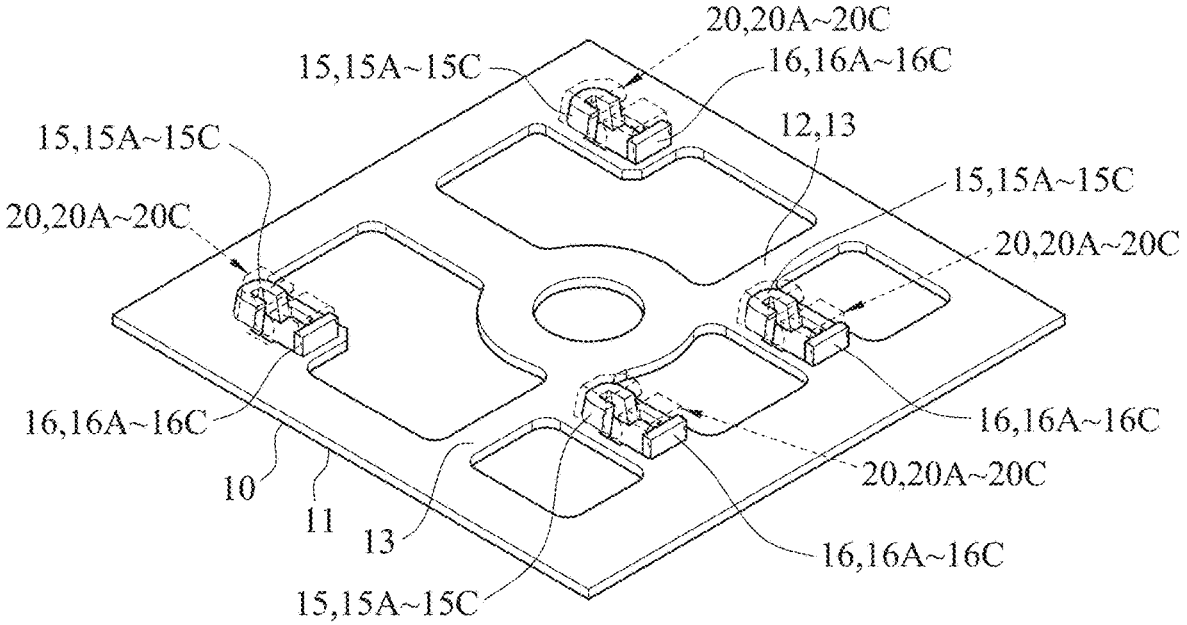
FIG. 10 illustrates a partial perspective view of a keyboard device according to another exemplary embodiment of the instant disclosure.

In some embodiments, the assembly area 13 of the substrate 10 may have the curved side wall 15, 15A, 15B, 15C but devoid of the opposite side wall 16, 16A, 16B, 16C. For example, as shown in FIG. 9, a plurality of curved side walls 15, 15A, 15B, 15C are disposed on the assembly area 13 of the substrate 10 for assembling with the limit connecting member 20, 20A, 20B, 20C, respectively. Alternatively, the opposite side wall 16, 16A, 16B, 16C in the foregoing embodiments may be a flat wall. For example, as shown in FIG. 10, a plurality of curved side walls 15, 15A, 15B, 15C and a plurality of opposite side walls 16, 16A, 16B, 16C are disposed on the assembly area 13 of the substrate 10, where the curved side walls 15, 15A, 15B, 15C are of curved shapes, and the opposite side walls 16, 16A, 16B, 16C are flat walls and are not curved. In the embodiment where the opposite side wall 16, 16A, 16B, 16C is a flat wall, the opposite side wall 16, 16A, 16B, 16C does not have the embedded groove 163, 163A, 163B, 163C, and the inner fixing portion 21, 21A, 21B, 21C is disposed between the curved side wall 15, 15A, 15B, 15C and the opposite side wall 16, 16A, 16B, 16C.

In some embodiments, the curved side wall 15, 15A, 15B, 15C and the opposite side wall 16, 16A, 16B, 16C may be the same structure (e.g., the curved side wall 15, 15A, 15B, 15C and the opposite side wall 16, 16A, 16B, 16C have the same curvature and the same shape). Moreover, the curved side wall 15, 15A, 15B, 15C and the opposite side wall 16, 16A, 16B, 16C may be arranged symmetrically (e.g., the curved side wall 15, 15A, 15B, 15C and the opposite side wall 16, 16A, 16B, 16C are symmetrically arranged at opposite sides of the through hole 14, 14A, 14B, 14C).

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A keyboard device comprising:

a substrate having a top surface and a bottom surface opposite to the top surface, wherein the top surface comprises an assembly area, the assembly area comprises a through hole and a curved side wall, the through hole is defined through the top surface and the bottom surface, the curved side wall is standingly disposed on the top surface, the curved side wall comprises a top edge and a bottom edge opposite to the top edge, the bottom edge is adjacently connected to a periphery portion of the through hole, and one side of the curved side wall facing the through hole comprises a recessed groove;

a limit connecting member disposed on the assembly area, wherein the limit connecting member comprises an inner fixing portion and an outer fixing portion, the inner fixing portion is received in the through hole, the inner fixing portion further has a protruding portion, and the protruding portion is received in the recessed groove, and the outer fixing portion encloses the curved side wall and fixes with the inner fixing portion;

a keycap disposed on the assembly area of the substrate; and a liftable connecting member connected between the keycap and the assembly area, wherein the liftable connecting member is assembled with the limit connecting member.

2. The keyboard device according to claim 1, wherein the assembly area further comprises an engaging hole adjacent to the curved side wall, the outer fixing portion further comprises an engaging portion, and the engaging portion is received in the engaging hole, so that the outer fixing portion is fixed with the inner fixing portion.

3. The keyboard device according to claim 2 wherein the engaging hole is further in communication with the through hole.

4. The keyboard device according to claim 2, wherein the bottom edge of the curved side wall has a notch, and the notch is in communication with the engaging hole.

5. The keyboard device according to claim 1, wherein the recessed groove of the curved side wall has a taper slope.

6. The keyboard device according to claim 1, wherein one side of the curved side wall facing the through hole further has a flange.

7. The keyboard device according to claim 1, wherein the curved side wall is an arc-shaped side wall or a U-shaped side wall.

8. The keyboard device according to claim 1, wherein the assembly area further comprises an opposite side wall standingly disposed on the top surface, the opposite side wall and the curved side wall are respectively at opposite sides of the through hole, and the inner fixing portion of the limit connecting member is fixed between the opposite side wall and the curved side wall.

9. The keyboard device according to claim 8, wherein the opposite side wall is spaced from the curved side wall, the limit connecting member comprises a pivot groove, and the pivot groove is between the opposite side wall and the curved side wall.

10. The keyboard device according to claim 8, wherein the opposite side wall is a flat wall.

11. The keyboard device according to claim 8, wherein the opposite side wall is a curved wall, and an embedded groove is at one side of the opposite side wall facing the through hole; the inner fixing portion of the limit connecting member further has a second protruding portion, and the second protruding portion is received in the embedded groove.

12. The keyboard device according to claim 11, wherein the opposite side wall and the curved side wall cooperatively enclose to form an annular wall.

13. The keyboard device according to claim 1, wherein the limit connecting member is of an L shape, and the limit connecting member has a standing portion and a hook portion; the standing portion is protruding from the top surface of the substrate and comprises the inner fixing portion and the outer fixing portion, and the hook portion is laterally extending from a top end of the standing portion.

* * * * *